US007748988B2

(12) United States Patent
Hori et al.

(10) Patent No.: US 7,748,988 B2
(45) **Date of Patent: *Jul. 6, 2010**

(54) CARD EDGE CONNECTOR AND METHOD OF MANUFACTURING THE SAME

(75) Inventors: Masashi Hori, Anjo (JP); Taku Iida, Nagoya (JP); Yasushi Matsumura, Toyota (JP); Yoshio Hironaka, Nukata-gun (JP); Takashi Kamiya, Okazaki (JP); Masashi Hiramatsu, Okazaki (JP); Toshihiro Miyake, Inuyama (JP); Hiroki Kamiya, Nagoya (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/292,500

(22) Filed: Nov. 20, 2008

(65) Prior Publication Data

US 2009/0191764 A1 Jul. 30, 2009

(30) Foreign Application Priority Data

Jan. 25, 2008 (JP) ..... 2008-015472

(51) Int. Cl.
*H01R 12/00* (2006.01)

(52) U.S. Cl. ..... 439/60; 439/634; 439/637; 439/417

(58) Field of Classification Search ..... 439/60, 439/634, 637, 404, 417, 660, 924.1
See application file for complete search history.

(56) References Cited

U.S. PATENT DOCUMENTS 3,555,493 A * 1/1971 Baumanis ..... 439/636
4,066,325 A * 1/1978 Pearce et al. ..... 439/634
5,239,748 A 8/1993 Hamilton
6,652,322 B2 * 11/2003 Ito et al. ..... 439/637
6,851,953 B2 * 2/2005 Kamiyamane ..... 439/59
7,369,415 B2 5/2008 Kojima (Continued)

FOREIGN PATENT DOCUMENTS

JP A-56-061777 A 5/1981

(Continued)

OTHER PUBLICATIONS

U.S. Appl. No. 12/292,494, filed Nov. 20, 2008, Hori et al.

(Continued)

*Primary Examiner*—Xuong M Chung-Trans
(74) *Attorney, Agent, or Firm*—Posz Law Group, PLC

(57) ABSTRACT

A card edge connector includes a housing, a first conductive part, a second conductive part, a connecting element, a first harness, and a second harness. The housing has an insertion hole for receiving an electronic substrate therein. The first conductive part and the second conductive part are disposed in the insertion hole and are configured to come in contact with respective terminals disposed on a surface of the electronic substrate. The connecting element is coupled with the second conductive part and extends in a direction approximately vertical to a planer direction of the electronic substrate so as to be away from the surface of the electronic substrate. The first harness is coupled with the first conductive part and the second harness penetrates a penetrated part of the connecting element.

12 Claims, 5 Drawing Sheets

U.S. PATENT DOCUMENTS

2009/0191760 A1* 7/2009 Hori et al. ..... 439/629

FOREIGN PATENT DOCUMENTS

| | | |
|---|---|---|
| JP | U-5-43489 | 6/1993 |
| JP | U-6-86366 | 12/1994 |
| JP | A-11-003753 | 1/1999 |
| JP | A-2000-164273 | 6/2000 |
| JP | A-2000-214214 | 8/2000 |
| JP | A-2001-230032 | 8/2001 |
| JP | A-2003-178834 | 6/2003 |
| JP | A-2004-47331 | 2/2004 |
| JP | A-2004-134214 | 4/2004 |
| JP | A-2004-273129 | 9/2004 |

OTHER PUBLICATIONS

Office Action issued from the Japanese Patent Office in the corresponding JP application No. 2008-015472 dated Dec. 1, 2009 (English translation enclosed).

* cited by examiner

CARD EDGE CONNECTOR AND METHOD OF MANUFACTURING THE SAME

CROSS REFERENCE TO RELATED APPLICATIONS

The present application is based on and claims priority to Japanese Patent Application No. 2008-15472 filed on Jan. 25, 2008, the contents of which are incorporated in their entirety herein by reference.

BACKGROUND OF THE INVENTION

1. Field of the Invention

The present invention relates to a card edge connector and a method of manufacturing a card edge connector.

2. Description of the Related Art

JP-A-2000-164273 discloses a connector that includes a housing and a plurality of terminals protruding from the housing. One end portions of the terminals are soldered with respective lands on a circuit board. The other end portions of the terminals are configured to be connected with an external connector. The other end portions of the terminals are arranged in a plurality of steps in a direction vertical to a planer direction of the circuit board in addition to the planer direction of the circuit board so that a width of the connector in the planer direction of the circuit board is reduced.

In the connector, each of the terminals is required to be soldered with the corresponding land on the circuit board. Thus, the number of components and the number of manufacturing process increase. In addition, when the circuit board is discarded, a segregated disposal of the circuit board requires time and effort.

In view of such circumstances, JP-A-2003-178834 discloses a card edge connector that includes a housing and a plurality of connector terminals disposed in the housing. In the present case, a plurality of contact terminals is disposed on a surface of a circuit board. When the circuit board is inserted into the housing, the contact terminals come in contact with the connector terminals, and thereby the contact terminals and the connector terminals are electrically coupled with each other.

In the card edge connector, the connector terminals are arranged in the housing so that the connector terminals can come in contact with the contact terminals disposed on the surface of the circuit board. Thus, the connector terminals are difficult to be arranged in a plurality of steps in a direction vertical to a planer direction of the circuit board.

JP-U-6-86366 discloses a card edge connector in which connector terminals are arranged in a plurality of steps in a direction vertical to a planer direction of a circuit board. The circuit board includes a multilayered substrate. An end portion of an inner substrate extends to an outside of an end portion of an outer substrate, and a plurality of terminals is disposed at the end portion of the inner substrate and the end portion of the outer substrate. Thus, a step is provided between an inner card edge part formed at the end portion of the inner substrate and an outer card edge part formed at the end portion of the outer substrate. In the card edge connector, a plurality of connector terminals are arranged in a plurality of steps in the direction vertical to the planer direction of the circuit board so as to correspond to the terminals of the circuit board.

In a case where the step is provided by using a thickness of one substrate in the multilayered substrate, it is difficult to provide a step having an enough height. Thus, the connector terminals of the card edge connector are formed into a shape fitted into a height of the step and the connector terminals are required to be closely arranged. As a result, a short circuit may occur.

SUMMARY OF THE INVENTION

In view of the foregoing problems, it is an object of the present invention to provide a card edge connector. Another object of the invention is to provide a method of manufacturing a card edge connector.

A card edge connector according to a first aspect of the invention includes a housing, a first conductive part, a second conductive part, a connecting element, a first harness, and a second harness. The housing has an insertion hole for receiving an end portion of an electronic substrate therein. The electronic substrate includes a first terminal and a second terminal disposed on a surface of the end portion, and the first terminal is located in front of the second terminal in an insertion direction that the end portion of the electronic substrate is inserted into the card edge connector. The first conductive part is disposed in the insertion hole and is configured to come in contact with the first terminal when the end portion of the electronic substrate is received by the housing. The second conductive part is disposed in the insertion hole and is configured to come in contact with the second terminal when the electronic substrate is received by the housing. The connecting element has a penetrated part and an end portion that is coupled with the second conductive part. The connecting element extends in a direction approximately vertical to a planer direction of the electronic substrate so as to be away from the surface. The first harness is coupled with the first conductive part and protrudes to an outside of the housing. The second harness penetrates the penetrated part of the connecting element and protrudes to an outside of the housing.

In the present card edge connector, the first harness configured to be coupled with the first terminal and the second harness configured to be coupled with the second terminal can be arranged in the direction approximately vertical to the planer direction of the electronic substrate so as to have a predetermined distance between the first harness and the second harness.

In a method of manufacturing a card edge connector according to a second aspect of the invention, a first harness is coupled with a first conductive part, and the first conductive part coupled with the first harness is disposed in a first cavity of a first housing. A connecting element is coupled with a second conductive part. The second conductive part coupled with the connecting element is disposed in a second cavity of a second housing in such a manner that the connecting element comes in contact with a contact surface of the second housing and an end portion of the connecting element protrudes from the second housing over an edge of the contact surface of the second housing. The first housing is fitted with the second housing in such a manner that a contact surface of the first housing comes in contact with the contact surface of the second housing and the first cavity communicates with the second housing so as to configurate an insertion hole for receiving an electronic substrate therein. A second harness is inserted into a storage cavity of the first housing from an opposite side of the contact surface of the first housing so that an end portion of the second harness reaches an opening of a groove provided at the end portion of the connecting element. A third housing is fitted with the second housing in such a manner that the end portion of the connecting element is covered with the third housing, the end portion of the second harness is pushed into the groove by the third housing, an insulating film covering a conductive portion of the second harness is peeled off at the end portion of the second harness, and the exposed conductive portion is fitted into the groove.

In the present manufacturing method, the first harness coupled with the first conductive part and the second harness coupled with the second conductive part can be arranged in the direction approximately vertical to a planer direction of the electronic substrate so as to have a predetermined distance between the first harness and the second harness.

In a method of manufacturing a card edge connector according to a third aspect of the invention, a first harness is coupled with a first conductive part, and the first conductive part coupled with the first harness is disposed in a first cavity of a first housing. A connecting element is coupled with a second conductive part. The second conductive part coupled with the connecting element is disposed in a second cavity of a second housing in such a manner that the connecting element comes in contact with a contact surface of the second housing and an end portion of the connecting element protrudes from the second housing over an edge of the contact surface of the second housing. The first housing is fitted with the second housing in such a manner that a contact surface of the first housing comes in contact with the contact surface of the second housing and the first cavity communicates with the second cavity so as to configurate an insertion hole for receiving an electronic substrate therein. A second harness is inserted into a storage cavity of the first housing from an opposite side of the contact surface of the first housing so that an end portion of the second harness penetrates a penetrated part provided at the end portion of the connecting element. An insulating film covering a conductive portion of the second harness is removed at the end portion of the second harness. The end portion of the second harness is soldered with the end portion of the connecting element. The third housing is fitted with the second housing in such a manner that the end portion of the connecting element is covered with the third housing.

In the present manufacturing method, the first harness coupled with the first conductive part and the second harness coupled with the second conductive part can be arranged in the direction approximately vertical to a planer direction of the electronic substrate so as to have a predetermined distance between the first harness and the second harness.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

Figure 1:
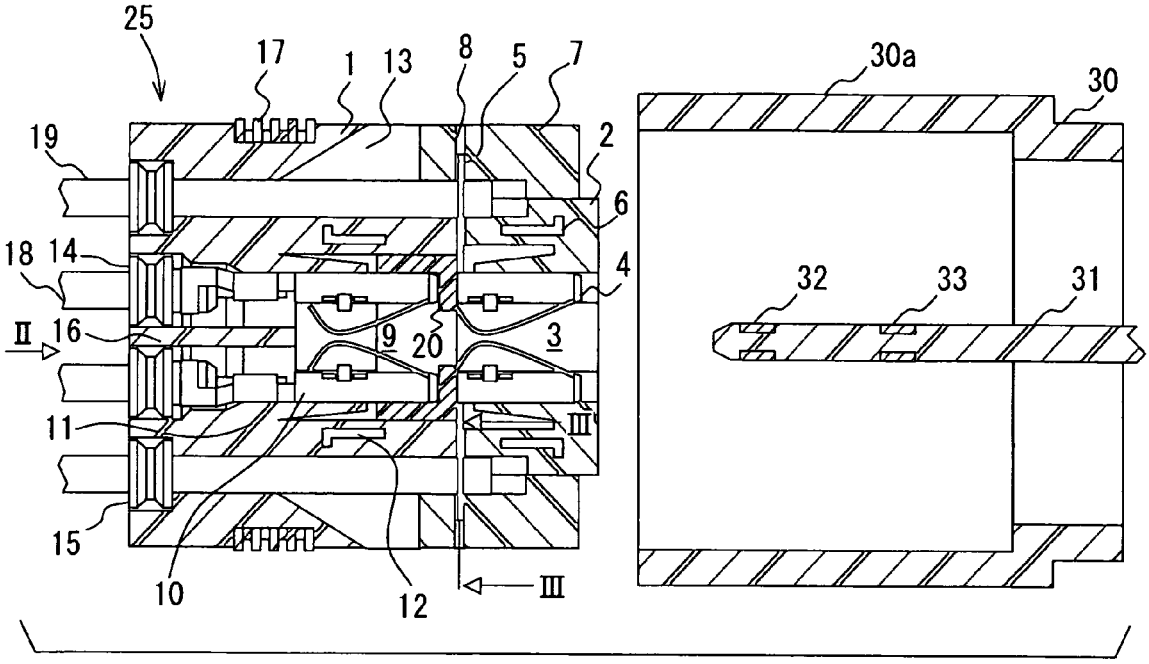
FIG. 1 is a cross-sectional view illustrating a card edge connector according to an exemplary embodiment.
Figure 3:
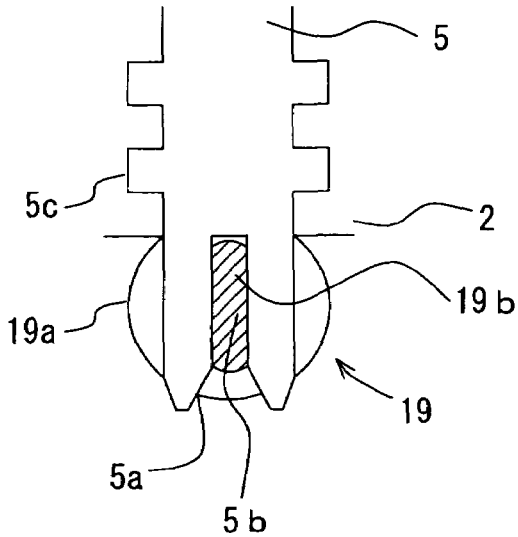
FIG. 3 is an enlarged cross-sectional view illustrating a part of the card edge connector taken along line III-III in FIG. 1.
Figure 4A:
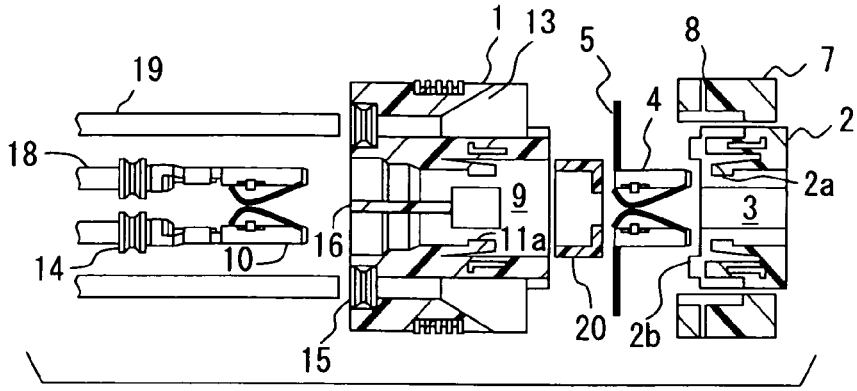
FIG. 4A-FIG. 4E are cross-sectional views illustrating an exemplary manufacturing process of the card edge connector.

A card edge connector 25 according to an exemplary embodiment of the invention will be described with reference to FIG. 1-FIG. 3. The card edge connector 25 includes a first housing 1, a second housing 2, and a third housing 7. The first housing 1, the second housing 2, and the third housing 7 are formed by resin injection molding, for example. The first housing 1 and the second housing 2 are fitted with each other in such a manner that a contact surface of the first housing 1 is in contact with a contact surface of the second housing 2. The second housing 2 has protruding portions 2*b* at the contact surface thereof, as illustrated in FIG. 4A. The first housing 1 has recess portions (not shown) at the contact surface thereof. By inserting the protruding portions 2*b* of the second housing 2 into the respective recess portions of the first housing 1, the first housing 1 and the second housing 2 are fitted with each other. The third housing 7 includes an upper housing part and a lower housing part. For example, each of the upper housing part and the lower housing has fitting portions (not shown) so that each of the upper housing part and the lower housing part is fitted with the first housing 1 and the second housing 2. For example, the fitting portions are located at two end portions of each of the upper housing part and the lower housing part in a direction approximately perpendicular to an insertion direction that an electronic substrate 31 is inserted into the card edge connector 25. The third housing 7 may also be fitted with only the second housing 2.

The first housing 1 has a first cavity 9 and the second housing 2 has a second cavity 3. The first cavity 9 and the second cavity 3 communicate with each other so as to configurate an insertion hole for receiving the electronic substrate 31 therein. The electronic substrate 31 is inserted into the insertion hole from the second cavity 3 to the first cavity 9.

The electronic substrate 31 is housed in a substrate housing 30. At an end portion of the substrate housing 30, a cover 30*a* is provided. The first housing 1, the second housing 2, and the third housing 7 are fitted into the cover 30*a*. The electronic substrate 31 extends to an inside of the cover 30*a*. The electronic substrate 31 has an upper surface and a lower surface. At an end portion of each of the upper surface and the lower surface of the electronic substrate 31, a plurality of front terminals 32 and a plurality of inner terminals 33 are disposed. The front terminals 32 are located in front of the inner terminals 33 in the insertion direction of the electronic substrate 31. The front terminals 32 are arranged on the upper surface and the lower surface of the electronic substrate 31 in a direction approximately perpendicular to the insertion direction of the electronic substrate 31. The inner terminals 33 are also arranged on the upper surface and the lower surface of the electronic substrate 31 in a direction approximately perpendicular to the insertion direction. In the electronic substrate 31 illustrated in FIG. 1, the inner terminals 33 are arranged in one row on each of the upper surface and the lower surface. Alternatively, the inner terminals 33 may be arranged in a plurality of rows on each of the upper surface and the lower surface.

The first housing 1 has a plurality of first connector pins 10 that is disposed in the first cavity 9. Each of the first connector pins 10 corresponds to a first conductive element. The first connector pins 10 are arranged so as to correspond to the front terminals 32 disposed on each of the upper surface and the lower surface of the electronic substrate 31. When the electronic substrate 31 is inserted into the first cavity 9, the electronic substrate 31 is interposed between the first connector pins 10 located on an upper side of the first cavity 9 and the first connector pins 10 located on a lower side of the first cavity 9. The first connector pins 10 are inserted into the first housing 1 from an opposite side of the contact surface of the first housing 1. The first housing 1 has a first partition 16. The first partition 16 divides a space where the first connector pins 10 are disposed into two.

The first connector pins 10 are made of a metal having a high electronic conductivity, for example, a copper alloy. As illustrated in FIG. 1, each of the first connector pins 10 includes a joint section, a body section, and a contact element. The joint section is joined with a first harness 18, for example, by press fitting or caulking. The body section extends from the joint section and has an approximately cylinder shape. The contact element is held by the body section. The contact element is elastically deformable so as to come in contact with the front terminals 32 of the electronic substrate 31 at a predetermined pressure. The body section has a stopper that prevents an excess deformation of the contact element. The first housing 1 further includes two second partitions 11 for dividing the first cavity 9 and storage cavities. On a surface of each of the second partitions 11, projections 11*a* are provided as illustrated in FIG. 4A. The projections 11 a are fitted into respective holes provided at the body sections of the first connector pins 10. Thereby, the first connector pins 10 are fixed at respective predetermined positions.

The first harnesses 18 joined with the respective first connector pins 10 are attached with respective individual seals 14. The individual seals 14 are press-fitted into respective seal-housing parts provided at an end portion of the first housing 1. The individual seals 14 prevent moisture and the like from seeping to the first housing 1 from a clearance between each of the first harnesses 18 and the first housing 1. The individual seals 14 are separated for each of the first harnesses 18 as illustrated in FIG. 2. The individual seals 14 are attached to the respective first harnesses 18 before the first connecter pins 10 are joined with the first harnesses 18. Thus, the first connector pins 10 are not required to be inserted into the respective individual seals 14 when the first connector pins 10 are inserted into the first housing 1. Thus, the contact elements of the first connector pins 10 are prevented from being attached with oil in the individual seals 14, and an electric connectivity between the contact elements of the first connector pins 10 and the front terminals 32 are not reduced.

The first housing 1 has the storage cavities on an upper side and a lower side of the first cavity 9. The storage cavities are provided for housing second harnesses 19 that are coupled with connecting elements 5. Each of the storage cavities opens on the contact surface of the first housing 1 and a side surface of the contact surfaces so as to provide an opening portion 13. Each of the second harnesses 19 extends from the storage cavity to a groove 5*b* through the opening portion 13. When each of the second harnesses 19 is disposed so as to extend through the corresponding connecting element 5, an end portion of each of the second harness 19 is required to be bent toward the side surface of the contact surface. Thus, the opening portion 13 of the storage cavity opens on the side surface of the contact surface.

Figure 2:
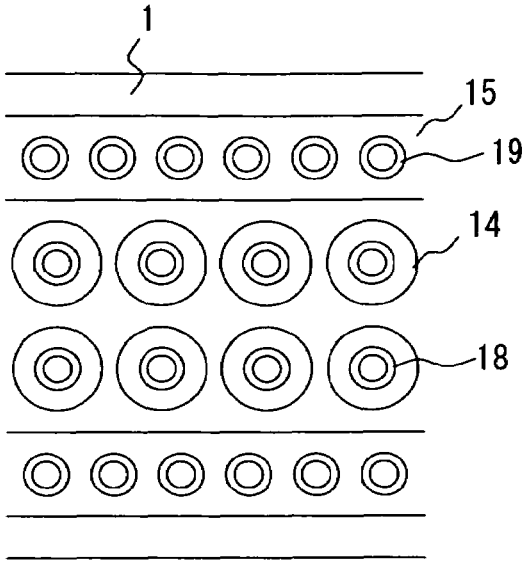
FIG. 2 is a side view illustrating the card edge connector viewed from a direction of arrow II in FIG. 1.

As illustrated in FIG. 2, the second harnesses 19 located on the upper side of the first connector pins 10 are attached with an integrated seal 15. In addition, the second harnesses 19 located on the lower side of the first connector pins 10 are attached with another integrated seal 15. That is, the integrated seals 15 are not separated for each of the second harnesses 19 and each of the integrated seals 15 is integrated for a plurality of the second harnesses 19. The integrated seals 15 are attached to the first housing 1 before each of the second harnesses 19 is inserted into the corresponding storage cavity of the first housing 1. Thus, each of the second harnesses 19 is inserted into the corresponding storage cavity through the corresponding integrated seal 15. By using the integrated seals 15, a distance between the second harnesses 19 can be reduced. Thus, the second harnesses 19 and the connecting elements 5 can be arranged with a high density.

On an external surface of the first housing 1, a sealing member 17 having a ring shape is disposed. The sealing member 17 is made of silicon rubber, for example. When the first housing 1, the second housing 2, and the third housing 7 of the card edge connector 25 are fitted into the cover 30*a* of the substrate housing 30, the sealing member 17 prevents moisture and the like from seeping into the substrate housing 30 from a clearance between an inner surface of the cover 30*a* and the external surfaces of the first housing 1, the second housing 2, and the third housing 7.

The first housing 1 is formed by resin injection molding. When the resin injection molding is performed, metal plates 12 are insert-molded in the second partitions 11. Because the metal plates 12 are insert-molded in the second partitions 11 and the metal plates 12 are located adjacent to the first connector pins 10, the metal plates 12 can improve the strength of the second partitions 11 that is a part of the first housing 1. Thus, the second partitions 11 are restricted from being creep-deformed and a contact pressure between the contact elements of the first connector pins 10 and the front terminals 32 of the electronic substrate 31 is restricted from being reduced.

In the second cavity 3 of the second housing 2, a plurality of second connector pins 4 is disposed. Each of the second connector pins 4 corresponds to a second conductive element. The second connector pins 4 are arranged so as to correspond to the inner terminals 33 disposed on the upper surface and the lower surface of the electronic substrate 31. When the electronic substrate 31 is inserted into the second cavity 3, the electronic substrate 31 is interposed between the second connector pins 4 located on the upper side of the second cavity 3 and the second connector pins 4 located on the lower side of the second cavity 3. Each of the second connector pins 4 includes a body section and a contact section. In addition, each of the second connector pins 4 is coupled with the respective connecting element 5. Each of the connecting elements 5 extends from an end of the body section of the corresponding second connector pin 4 adjacent to the first housing 1, and each of the connecting elements 5 extends approximately vertically along the contact surface of the second housing 2 in a direction away from the electronic substrate 31. An end portion of each of the connecting element 5 protrudes from the second housing 2 over an edge of the contact surface of the second housing 2.

The second connector pins 4 and the connecting elements 5 are inserted into the second housing 1 from the side where the electronic substrate 31 is inserted. The second housing 2 has a holding part that holds the second connector pins 4. On an external surface of the second housing 2, a recess portion for receiving an end portion of each of the second harnesses 19 is provided. The holding part includes a plurality of projections 2*a* on a surface defining the second cavity 3, as illustrated in FIG. 4*a*. The projections 2*a* are inserted into respective holes provided at the body sections of the second connector pins 4. Thereby, the second connector pins 4 are fixed to the holding part.

When the second connector pins 4 are fixed to the holding part, the connecting elements 5 coupled with the second connector pins 4 are attached firmly to the contact surface of the second housing 2. At the end portion of each of the connecting elements 5, the groove 5*b* is provided so that a conductive portion 19*b* of the corresponding second harness 19 penetrates through the groove 5*b*. The groove 5*b* has an opening 5*a* on an end side of the connecting element 5. Each of the second harnesses 19 includes the conductive portion

19*b* and an insulating film 19*a* covering the conductive portion 19*b*. Each of the second harnesses 19 is arranged at the opening 5*a* of the corresponding connecting element 5. Then, each of the second harnesses 19 is pressed into the corresponding groove 5*b* when the third housing 7 is fitted with the first housing 1 and the second housing 2. A width of the grooves 5*b* is less than a diameter of the conductive portions 19*b* of the second harnesses 19. Thus, when each of the second harnesses 19 is pressed into the corresponding groove 5*b*, the insulating film 19*a* of each of the second harnesses 19 is peeled off by the corresponding connecting elements 5 and the conductive portion 19*b* is exposed to an outside. Thereby, the exposed conductive portion 19*b* comes in contact with the corresponding connecting element 5 and the second harness 19 is electrically coupled with the corresponding connecting element 5.

Each of the connecting elements 5 has a plurality of projections 5*c* protruding from side surfaces of each of the connecting elements 5. The second housing 2 has a plurality of recess portion (not shown) at the contact surface so as to correspond to the projections 5*c* of the connecting elements 5. Each of the projections 5*c* of the connecting elements 5 are fitted into the corresponding recess portion of the second housing 2 so that the connecting elements 5 are fixed to the contact surface of the second housing 2. Thus, even if each of the connecting elements 5 is applied with a pressure when each of the second harnesses 19 is pressed into the groove 5*b* of the corresponding connecting element 5, the connecting element 5 is restricted from falling off the second housing 2. Thus, an electric connectivity between the second harnesses 19 and the corresponding connecting element 5 is ensured. The projections 5*c* of the connecting element 5 may protrude toward the contact surface of the second housing 2. The second housing 2 may have recess portions at the contact surface so that the projections 5*c* protruding toward the contact surface are fitted into the respective recess portions.

The second housing 2 is formed by resin injection molding in a manner similar to the first housing 1. At the time of the injection molding, metal plates 6 are insert-molded so that the metal plates 6 are located in the holding part. Thereby, the strength of the holding part that holds the second connector pins 4 is improved. Thus, the holding part is restricted from being creep-deformed and a contact pressure between the contact elements of the second connector pins 4 and the inner terminals 33 of the electronic substrate 31 is restricted from being reduced.

In the first cavity 9 of the first housing 1, a supporting member 20 is disposed for stably fixing the first connector pins 10 and the second connector pins 4. The supporting member 20 has an open box shape. The supporting member 20 has a through hole at a bottom portion thereof so that the electronic substrate 31 is inserted into the first cavity 9 from the through hole. An inner side surface of the supporting member 20 is in contact with side surfaces of the body sections of the first connector pins 10. An inner bottom surface of the supporting member 20 is in contact with end surfaces of the body sections of the first connector pins 10. An outer bottom surface of the supporting member 20 is in contact with end surfaces of the second connector pins 4.

The third housing 7 is attached to the first housing 1 and the second housing 2. The third housing 7 has recess portions at an attached surface thereof for receiving the end portions of the second harnesses 19. In addition, the third housing 7 has slits 8 at portions corresponding to the end portions of the connecting elements 5 protruding from the second housing 2. Thus, the third housing 7 can be attached to the first housing 1 and the second housing 2 so as to cover the end portions of the second harnesses 19 protruding from the first housing 1 and the end portions of the connecting elements 5 protruding from the second housing 2. When the third housing 7 is attached to the first housing 1 and the second housing 2, the third housing 7 presses the end portions of the second harnesses 19 into the corresponding grooves 5*b* of the connecting elements 5.

An exemplary method of manufacturing the card edge connector 25 will now be described with reference to FIG. 4A-FIG. 4E. At a process illustrated in FIG. 4A, the first harnesses 18 are coupled with the respective first connector pins 10. The connecting elements 5 are coupled with the respective second connector pins 4.

Figure 4B:
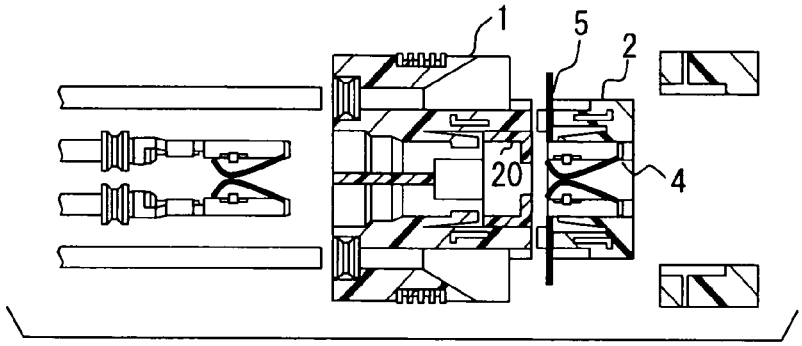

At a process illustrated in FIG. 4B, the second connector pins 4 integrated with the respective connecting elements 5 are inserted into the second housing 2 from the contact-surface side of the second housing 2. Thereby, the second connector pins 4 are fixed to the holding part of the second housing 2, and the connecting elements 5 are attached firmly to the contact surface of the second housing 2. At this time, the end portions of the connecting elements 5 protrude from the second housing 2 over the edge of the contact surface of the second housing 2. In addition, the supporting member 20 is inserted into the first cavity 9 in the first housing 1. The supporting member 20 is temporarily fixed in the first cavity 9 in the first housing 1 by being held between the two second partitions 11.

Figure 4C:
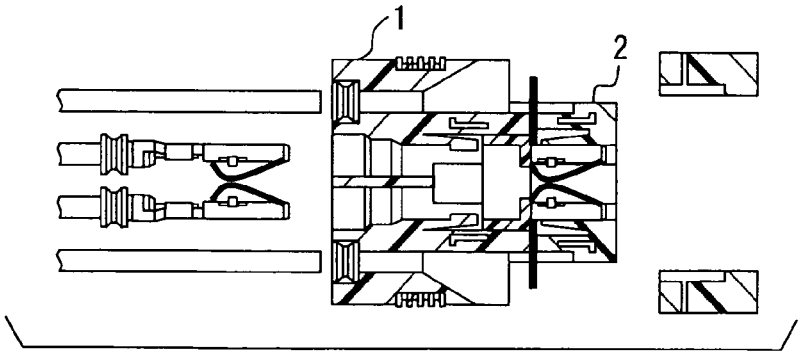

Next, as illustrated in FIG. 4C, the contact surface of the second housing 2 is brought in contact with the contact surface of the contact surface of the first housing 1, and the second housing 2 is fitted with the first housing 1. By inserting the protruding portions 2*b* of the second housing 2 into the respective recess portions of the first housing 1, the first housing 1 and the second housing 2 are fitted with each other.

Figure 4D:
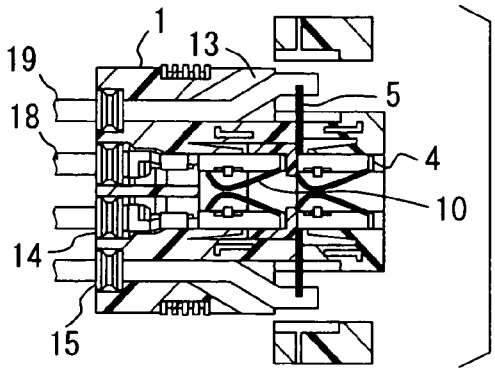

Next, as illustrated in FIG. 4D, the first connector pins 10 coupled with the respective first harnesses 18 and the second harnesses 19 are inserted into the first housing 1 from an opposite side of the contact surface of the first housing 1. At this time, the first harnesses 18 are attached with the individual seals 14. Thus, the first connector pins 10 are inserted into the first housing 1 without being inserted into the individual seals 14. The holes of the body sections of the first connector pins 10 are fitted with the corresponding projections 11*a* of the second partitions 11. Thereby, the first connector pins 10 are fixed to the second partitions 11.

The integrated seals 15 to be attached with the second harnesses 19 are preliminarily press-fitted into the first housing 1. The second harnesses 19 are inserted into the first housing 1 through the corresponding integrated seal 15. When the second harnesses 19 penetrate through the corresponding integrated seal 15, the conductive portions 19*b* of the second harnesses 19 are covered with the insulating films 19*a*. Thus, the conductive portions 19*b* of the second harnesses 19 are prevented from being attached with oil included in the integrated seal 15. The second harnesses 19 are inserted into the first housing 1 until the end portions the second harnesses 19 reach the connecting elements 5 over the opening portion 13 of the first housing 1. The width of the grooves 5*b* of the connecting elements 5 is less than the diameter of the conductive portions 19*b* of the second harnesses 19. Thus, the second harnesses 19 cannot penetrate through the grooves 5*b*, and the end portions of the second harnesses 19 are bent and are put on the openings 5*a* of the grooves 5*b* of the connecting elements 5. The second harnesses 19 have a bendability so that the end portions of the second harnesses 19 are bendable. The opening portions 13 of the first housing 1 are provided so as to communicate with the storage cavity for the second harnesses 19. Thus, as illustrated in FIG. 4D, the end portions of the second harnesses 19 can be bent in the opening portions 13 so as to engage with the openings 5*a* of the grooves 5*b* of the connecting elements 5.

Figure 4E:
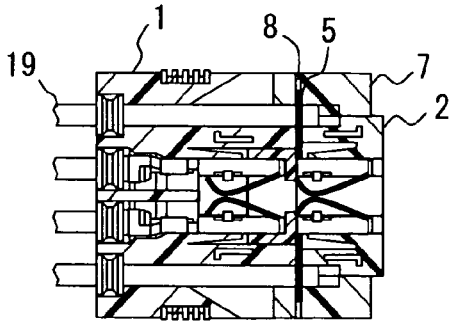

At last, as illustrated in FIG. 4E, the third housing 7 is attached to the first housing 1 and the second housing 2. When the third housing 7 is attached, the third housing 7 presses the end portions of the second harnesses 19 put on the openings 5*a* of the grooves 5*b* into the grooves 5*b*. Thus, the insulating films 19*a* at the end portions of the second harnesses 19 are peeled off, and the exposed conductive portions 19*b* are fitted into the grooves 5*b*. In the present embodiment, the second harness 19 can be inserted into the first housing 1 in a state where the insulating films 19*a* covers the conductive portions 19*b*. Thus, the productivity of the card edge connector 25 can be improved.

In the above-described method, the second housing 2 is fixed to the first housing 1 before the first connector pins 10 are inserted into the first housing 1. The second housing 2 may also be fixed to the first housing 1 after the first connector pins 10 are inserted into the first housing 1 and are arranged at predetermined positions. The second harnesses 19 may be inserted into the first housing 1 before the first housing 1 and the second housing 2 are fitted with each other.

In the present card edge connector 25, the first connector pins 10 are configured to come in contact with the respective front terminals 32 when the electronic substrate 31 is received by the first housing 1 and the second housing 2. The second connector pins 4 are configured to come in contact with the respective inner terminals 33 when the electronic substrate 31 is received by the first housing 1 and the second housing 2. The first connector pins 10 located on the upper side of the first cavity 9 and the second connector pins 4 located on the upper side of the second cavity 3 are located in a plan approximately parallel to the planer direction of the electronic substrate 31. In addition, the first connector pins 10 located on the lower side of the first cavity 9 and the second connector pins 4 located on the lower side of the second cavity 3 are located in a plan approximately parallel to the planer direction of the electronic substrate 31.

The connecting elements 5 are joined with the respective second connector pins 4 and the connecting elements 5 extend approximately vertically in the direction away from the surfaces of the electronic substrate 31. Each of the connecting elements 5 has the groove 5*b* through which the conductive portion 19*b* of the corresponding second harness 19 penetrate. Thus, even if the front terminals 32 and the inner terminals 33 are arranged along the insertion direction of the electronic substrate 31, the first connector pins 10, which are electrically coupled with the front terminals 32, and the end portions of the connecting elements 5 which are electrically coupled with the inner terminals 33 through the second connector pins 4 can be arranged in the direction approximately vertical to the planer direction of the electronic substrate 31 so that a predetermined distance is provided between the first connector pins 10 and the end portions of the connecting elements 5. As a result, the first harnesses 18 electrically coupled with the front terminals 32 and the second harnesses 19 electrically coupled with the inner terminals 33 through the connecting elements 5 can be arranged in a plurality of steps in the direction approximately vertical to the planer direction of the electronic substrate 31.

Although the present invention has been fully described in connection with the exemplary embodiments thereof with reference to the accompanying drawings, it is to be noted that various changes and modifications will become apparent to those skilled in the art.

Figure 5A:
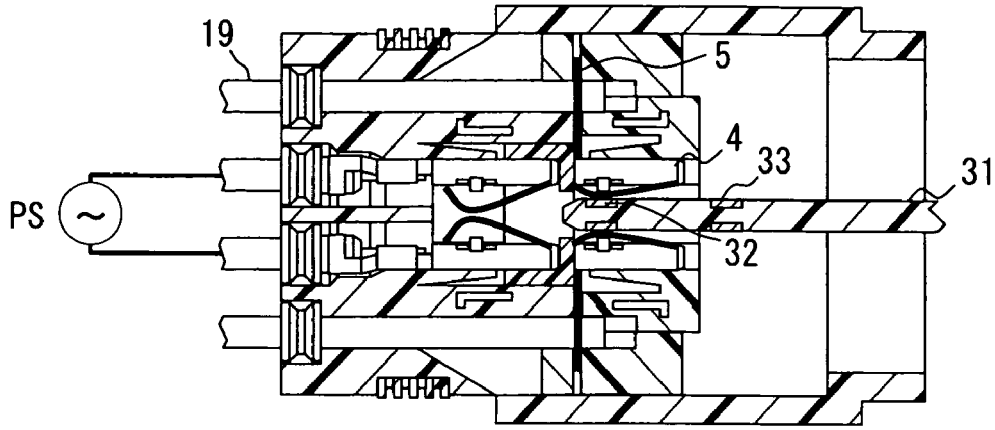
FIG. 5A is a cross-sectional view illustrating a card edge connector according to a modification and FIG. 5B is a cross-sectional view illustrating a card edge connector according to another modification.
Figure 5B:
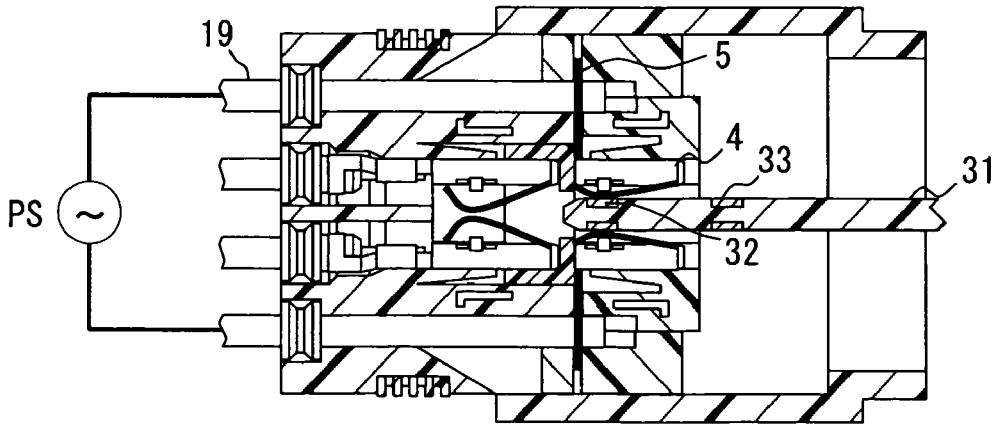
Figure 6:
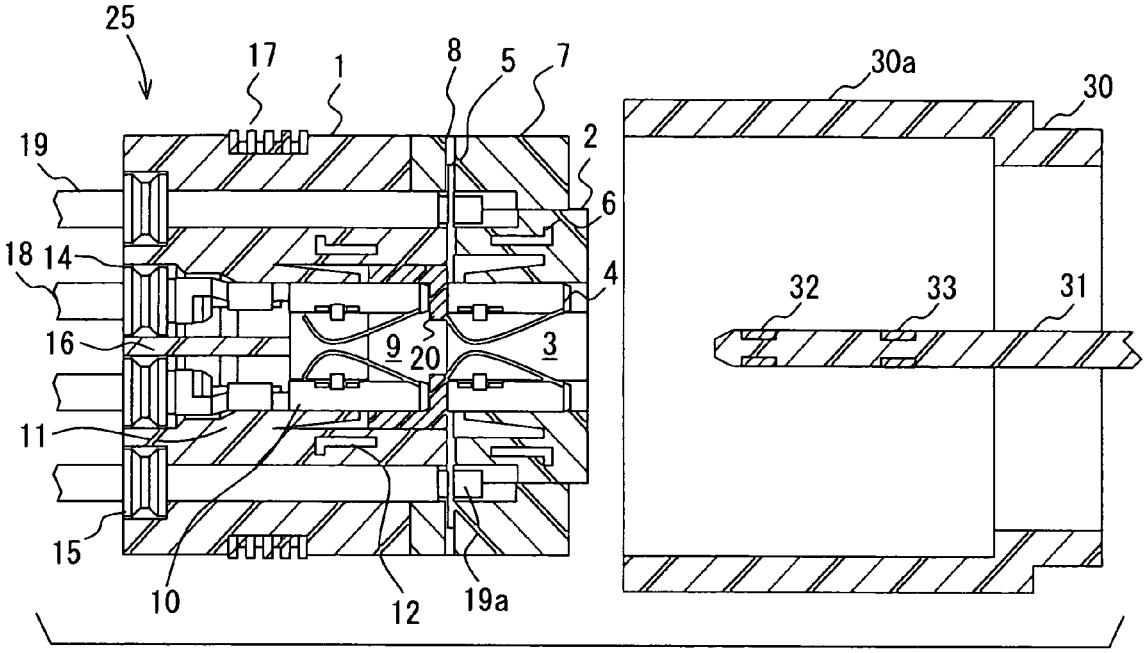
FIG. 6 is a cross-sectional view illustrating a card edge connector according to another modification.

For example, the first harnesses 18 joined with the first connector pins 10 may be coupled with a power source (PS) as illustrated in FIG. 5A. In the present case, electricity can be supplied from the power source to a circuit formed on the electronic substrate 31 through the first connector pins 10 and the front terminals 32 when the electronic substrate 31 is completely inserted into the card edge connector 25 and the first connector pins 10 come in contact with the front terminals 32. In a case where the second harnesses 19 to be electrically coupled with the inner terminals 33 are coupled with the power source, as illustrated in FIG. 5B, electricity can possibly flow through unintended pathway, i.e., through the second harnesses 19, the second connector pins 4, and the front terminals 32, before the electronic substrate 31 is completely inserted into the card edge connector 25 and the second connector pins 4 come in contact with the inner terminals 33.

In the above-described embodiment, the front terminals 32 and the inner terminals 33 are disposed on both of the upper surface and the lower surface of the electronic substrate 31. The first harnesses 18 coupled with the first connector pins 10 and the second harnesses 19 coupled with the connecting elements 5 are arranged in two steps in the direction approximately vertical to the planer direction of the electronic substrate 31 so as to correspond to the front terminals 32 and the inner terminals 33 disposed on the upper surface of the electronic substrate 31. In addition, the first harnesses 18 coupled with the first connector pins 10 and the second harnesses 19 coupled with the connecting elements 5 are arranged in two steps in the direction approximately vertical to the planer direction of the electronic substrate 31 so as to correspond to the front terminals 32 and the inner terminals 33 disposed on the lower surface of the electronic substrate 31. The front terminals 32 and the inner terminals 33 may also be disposed only one of the upper surface and the lower surface of the electronic substrate 31. Alternatively, the front terminals 32 may be disposed on both of the surfaces, the inner terminals 33 may be disposed on one of the surfaces, and the first harnesses 18 and the second harnesses 19 may be arranged in a plurality of steps on only one side corresponding to the one of the surfaces. When the first harnesses 18 and the second harnesses 19 are arranged in a plurality of steps, the number of step may be greater than two.

In the above-described exemplary embodiment, the insulating film 19*a* of the second harnesses 19 are peeled off when the second harnesses 19 are pressed into the corresponding grooves 5*b* by the third housing 7, and thereby the conductive portion 19*b* of the second harnesses 19 and the corresponding connecting elements 5 are electrically coupled with each other. Alternatively, the insulating films 19*a* at the end portions of the second harnesses 19 may be removed before or after the second harnesses 19 are inserted into the first housing 1. In the present case, the exposed conductive portions 19*b* may be fitted into penetrated parts provided at the end portion of the connecting elements 5, and the conductive portions 19*b* and the connecting elements 5 may be soldered. By soldering the conductive portions 19*b* of the second harnesses 19 and the connecting elements 5, an electric conductivity and a mechanical conductivity between the second harnesses 19 and the connecting elements 5 can be improved. In the present case, each of the penetrated parts may be the groove 5*b* or a though hole, for example. The third housing 7 is attached to the first housing 1 and the second housing 2 after the conductive portions 19*b* and the connecting elements 5 are soldered.

What is claimed is:

1. A card edge connector adapted to receive an electronic substrate, the electronic substrate including a plurality of terminals disposed on an end portion of the electronic substrate, the plurality of terminals including a first terminal and a second terminal disposed on a first surface of the electronic substrate, the first terminal located in front of the second terminal in an insertion direction that the end portion of the electronic substrate is inserted into the card edge connector, the card edge connector comprising:

a housing having an insertion hole for receiving the end portion of the electronic substrate therein;

a first conductive part disposed in the insertion hole, the first conductive part configured to come in contact with the first terminal when the electronic substrate is received by the housing;

a second conductive part disposed in the insertion hole, the second conductive part configured to come in contact with the second terminal when the electronic substrate is received by the housing;

a first connecting element having a penetrated part and an end portion that is coupled with the second conductive part, the first connecting element extending in a direction approximately vertical to a planer direction of the electronic substrate so as to be away from the first surface of the electronic substrate;

a first harness coupled with the first conductive part and protruding to an outside of the housing; and a second harness penetrating the penetrated part of the first connecting element and protruding to an outside of the housing.

2. The card edge connector according to claim 1, wherein:

the plurality of terminals further includes a third terminal and a fourth terminal disposed on a second surface of the electronic substrate that is opposite to the first surface; and the third terminal is located in front of the fourth terminal in the insertion direction, the card edge connector further comprising:

a third conductive part disposed in the insertion hole, the third conductive part configured to come in contact with the third terminal when the electronic substrate is received by the housing;

a fourth conductive part disposed in the insertion hole, the fourth conductive part configured to come in contact with the fourth terminal when the electronic substrate is received by the housing;

a second connecting element having a penetrated part and an end portion that is coupled with the fourth conductive part, the second connecting element extending in the direction approximately vertical to the planer direction of the electronic substrate so as to be away from the second surface;

a third harness coupled with the third conductive part and protruding to the outside of the housing; and a fourth harness penetrating the penetrated part of the second connecting element and protruding to the outside of the housing.

3. The card edge connector according to claim 1, wherein:

the plurality of terminals further includes a third terminal and a fourth terminal disposed on the first surface of the electronic substrate;

the first terminal and the third terminal are arranged in a direction approximately perpendicular to the insertion direction; and the second terminal and the fourth terminal are arranged in the direction approximately perpendicular to the insertion direction, the card edge connector further comprising:

a third conductive part disposed in the insertion hole, the third conductive part configured to come in contact with the third terminal when the electronic substrate is received by the housing;

a fourth conductive part disposed in the insertion hole, the fourth conductive part configured to come in contact with the fourth terminal when the electronic substrate is received by the housing;

a second connecting element having a penetrated part and an end portion that is coupled with the fourth conductive part, the second connecting element extending in the direction approximately vertical to the planer direction of the electronic substrate so as to be away from the first surface;

a third harness coupled with the third conductive part and protruding to an outside of the housing;

a fourth harness penetrating the penetrated part of the second connecting element and protruding to the outside of the housing;

a first individual seal attached to the first harness so as to seal a clearance between the first harness and the housing;

a second individual seal attached to the third harness so as to seal a clearance between the third harness and the housing; and an integrated seal attached to the second harness and the fourth harness so as to seal a clearance between the second harness and the housing and a clearance between the fourth harness and the housing.

4. The card edge connector according to claim 1, further comprising a metal frame disposed in the housing and located adjacent to one of the first conductive part and the second conductive part.

5. The card edge connector according to claim 1, wherein the first conductive part is configured to be coupled with a power source so that an electricity is supplied from the power source to a circuit formed on the electronic substrate through the first conductive part.

6. The card edge connector according to claim 1, wherein:

the housing includes a first housing, a second housing, and a third housing;

the first housing has a contact surface, a first cavity extending from the contact surface, and a storage cavity extending from the contact surface;

the second housing has a contact surface and a second cavity extending through the second housing;

the contact surface of the first housing is in contact with the contact surface of the second housing;

the first cavity communicates with the second cavity so as to configurate the insertion hole;

the first conductive part is disposed in the first cavity;

the second conductive part is disposed in the second cavity;

the first connecting element is in contact with the contact surface of the second housing and protrudes from the second housing over an edge of the contact surface of the second housing;

the penetrated part is provided at the protruding portion of the first connecting element;

the second harness penetrates the storage cavity of the first housing and the end portion of the second harness protrudes from the first housing; and the third housing has a slit and is fitted with the first housing and the second housing in such a manner that the protruding portion of the first connecting element is fitted into the slit and the end portion of the second harness is covered with the third housing.

7. The card edge connector according to claim 6, wherein:

the first connecting element has a projection;

the second housing has a recess portion at the contact surface; and the projection is fitted into the recess portion.

8. The card edge connector according to claim 1, wherein the first conductive part and the second conductive part are located in a plane approximately parallel to the planer direction of the electronic substrate when the electronic substrate is received by the housing.

9. A method of manufacturing a card edge connector adapted to receive an electronic substrate, the method comprising:

coupling a first harness with a first conductive part;

disposing the first conductive part coupled with the first harness in a first cavity of a first housing;

coupling a connecting element with a second conductive part;

disposing the second conductive part coupled with the connecting element in a second cavity of a second housing in such a manner that the connecting element comes in contact with a contact surface of the second housing and an end portion of the connecting element protrudes from the second housing over an edge of the contact surface of the second housing;

fitting the first housing with the second housing in such a manner that a contact surface of the first housing comes in contact with the contact surface of the second housing and the first cavity communicates with the second cavity so as to configurate an insertion hole for receiving the electronic substrate therein;

inserting a second harness into a storage cavity of the first housing from an opposite side of the contact surface of the first housing so that an end portion of the second harness reaches an opening of a groove provided at the end portion of the connecting element; and fitting a third housing with the second housing in such a manner that the end portion of the connecting element is covered with the third housing, the end portion of the second harness is pushed into the groove by the third housing, an insulating film covering a conductive portion of the second harness is peeled off at the end portion of the second harness, and the exposed conductive portion is fitted into the groove.

10. The method according to claim 9, wherein the connecting element comes in contact with a contact surface of the second housing in such a manner that a projection provided at the connecting element is fitted into a recess portion provided at the contact surface of the second housing.

11. A method of manufacturing a card edge connector adapted to receive an electronic substrate, the method comprising:

coupling a first harness with a first conductive part;

disposing the first conductive part coupled with the first harness in a first cavity of a first housing;

coupling a connecting element with a second conductive part;

disposing the second conductive part coupled with the connecting element in a second cavity of a second housing in such a manner that the connecting element is in contact with a contact surface of the second housing and an end portion of the connecting element protrudes from the second housing over an edge of the contact surface of the second housing;

fitting the first housing with the second housing in such a manner that a contact surface of the first housing comes in contact with the contact surface of the second housing and the first cavity communicates with the second cavity so as to configurate an insertion hole for receiving the electronic substrate therein;

inserting a second harness into a storage cavity of the first housing from an opposite side of the contact surface of the first housing so that an end portion of the second harness penetrates a penetrated part provided at the end portion of the connecting element, wherein an insulating film covering a conductive portion of the second harness is removed at the end portion of the second harness;

soldering the end portion of the second harness and the end portion of the connecting element; and fitting a third housing with the second housing in such a manner that the end portion of the connecting element is covered with the third housing.

12. The method according to claim 11, wherein the connecting element comes in contact with a contact surface of the second housing in such a manner that a projection provided at the connecting element is fitted into a recess portion provided at the contact surface of the second housing.

* * * * *